US011562846B2

(12) United States Patent
Kurobe

(10) Patent No.: US 11,562,846 B2
(45) Date of Patent: Jan. 24, 2023

(54) COIL COMPONENT AND METHOD FOR MANUFACTURING THE SAME

(71) Applicant: Murata Manufacturing Co., Ltd., Kyoto-fu (JP)

(72) Inventor: Junji Kurobe, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 931 days.

(21) Appl. No.: 16/201,847

(22) Filed: Nov. 27, 2018

(65) Prior Publication Data

US 2019/0180917 A1 Jun. 13, 2019

(30) Foreign Application Priority Data

Dec. 7, 2017 (JP) ..... JP2017-235386

(51) Int. Cl.

| | |
|---|---|
| ***H01F 5/00*** | (2006.01) |
| ***H01F 27/28*** | (2006.01) |
| ***H01F 41/04*** | (2006.01) |
| ***H01F 27/24*** | (2006.01) |
| ***H01F 17/06*** | (2006.01) |
| ***H01F 27/29*** | (2006.01) |

(Continued)

(52) U.S. Cl.

CPC ..... *H01F 27/2804* (2013.01); *H01F 17/0006* (2013.01); *H01F 17/0013* (2013.01); *H01F 17/062* (2013.01); *H01F 27/24* (2013.01); *H01F 27/2895* (2013.01); *H01F 27/292* (2013.01); *H01F 41/041* (2013.01); *H01F 41/10* (2013.01); *H01F 2017/002* (2013.01); *H01F 2027/2814* (2013.01)

(58) Field of Classification Search

CPC .. H01F 27/2804; H01F 27/24; H01F 17/0006; H01F 17/0013; H01F 27/292

USPC ..... 336/200

See application file for complete search history.

(56) References Cited

U.S. PATENT DOCUMENTS 6,918,173 B2 * 7/2005 Ahn ..... H01F 17/0033 29/608

7,304,558 B1 * 12/2007 Pleskach ..... H01F 17/0033 29/602.1

(Continued)

FOREIGN PATENT DOCUMENTS

JP H07-122451 A 5/1995

JP 2001-127435 A 5/2001

(Continued)

OTHER PUBLICATIONS

An Office Action; "Notice of Reasons for Refusal," mailed by the Japanese Patent Office dated Aug. 11, 2020, which corresponds to Japanese Patent Application No. 2017-235386 and is related to U.S. Appl. No. 16/201,847 with English language translation.

(Continued)

*Primary Examiner* — Mang Tin Bik Lian

*Assistant Examiner* — Joselito S. Baisa

(74) *Attorney, Agent, or Firm* — Studebaker & Brackett PC

(57) ABSTRACT

A coil component includes a main body portion containing resin and having a hole portion, a coil provided in the main body portion, and a substantially cylindrical pipe arranged inside the hole portion. The coil includes an inner wiring embedded in the pipe and an outer wiring exposed from the main body portion. The inner wiring and the outer wiring are integrally continuous.

10 Claims, 7 Drawing Sheets

(51) Int. Cl.
*H01F 17/00* (2006.01)
*H01F 41/10* (2006.01)

(56) References Cited

U.S. PATENT DOCUMENTS 7,375,611 B1 * 5/2008 Pleskach ..... H01F 27/2804 336/229
8,327,524 B2 * 12/2012 Brunner ..... H01F 37/00 336/200
9,691,541 B2 * 6/2017 Tanaka ..... H01F 27/02
9,799,722 B1 * 10/2017 Lu ..... H01L 23/5389
9,899,137 B2 * 2/2018 Kostelnik ..... H01F 17/0006
11,127,527 B2 * 9/2021 Hasegawa ..... H01F 27/26
2006/0176139 A1 * 8/2006 Pleskach ..... H01F 17/0033 336/223
2011/0291787 A1 12/2011 Dalmia et al.
2014/0266547 A1 * 9/2014 Watanabe ..... H01F 41/042 336/200
2014/0292466 A1 * 10/2014 Watanabe ..... H01F 27/29 205/118
2015/0340150 A1 * 11/2015 Nakamura ..... H01F 27/24 336/200
2016/0163442 A1 * 6/2016 Yoon ..... H01F 27/255 336/200
2016/0181007 A1 * 6/2016 Shiokawa ..... H01F 41/08 336/221
2017/0084384 A1 * 3/2017 Otsubo ..... H01F 17/0033
2017/0213638 A1 * 7/2017 Otsubo ..... H01F 27/2804
2017/0301453 A1 * 10/2017 Jo ..... H01F 41/041
2019/0027297 A1 1/2019 Sasaki et al.
2019/0333681 A1 * 10/2019 Wang ..... H01F 41/046
2019/0341184 A1 * 11/2019 Guo ..... H01F 27/24

FOREIGN PATENT DOCUMENTS

JP 2003-332132 A 11/2003
JP 2013-532375 A 8/2013
JP 2014-038884 A 2/2014
JP 2015-173189 A 10/2015
JP 2015173189 A * 10/2015
JP 2016-115895 A 6/2016
WO 2015/190229 A1 12/2015
WO 2017/169621 A1 10/2017
WO WO-2018123410 A1 * 7/2018 ..... H01F 17/00

OTHER PUBLICATIONS

An Office Action; "Notification of Reasons for Refusal," Mailed by the Japanese Patent Office dated Feb. 25, 2020, which corresponds to Japanese Patent Application No. 2017-235386 and is related to U.S. Appl. No. 16/201,847 with English language translation.

* cited by examiner

COIL COMPONENT AND METHOD FOR MANUFACTURING THE SAME

CROSS-REFERENCE TO RELATED APPLICATION

This application claims benefit of priority to Japanese Patent Application No. 2017-235386, filed Dec. 7, 2017, the entire content of which is incorporated herein by reference.

BACKGROUND

Technical Field

The present disclosure relates to a coil component and a method for manufacturing the same.

Background Art

An existing coil component is disclosed in Japanese Unexamined Patent Application Publication No. 2015-173189. The coil component includes a coil core and a coil electrode spirally wound around the core.

The coil electrode has a plurality of first columnar conductors arranged in outer side portions of the core, a plurality of second columnar conductors arranged in inner side portions of the core, a plurality of first connecting members connecting one ends of the first columnar conductors and the second columnar conductors, and a plurality of second connecting members connecting the other ends of the first columnar conductors and the second columnar conductors. Ones of the first connecting members and the second connecting members are formed of a bonding wire.

SUMMARY

In the above-described existing coil component, ones of the first connecting members and the second connecting members and the first columnar conductors and the second columnar conductors are connected by soldering because ones of the first connecting members and the second connecting members are formed of the bonding wire. Therefore, bonding surfaces between the connecting members and the columnar conductors are generated, and the bonding strength between the connecting members and the columnar conductors is weakened. Thus, when stress is applied thereto by heat application or the like, disconnection of the connecting members and the columnar conductors may occur.

Accordingly, the present disclosure provides a coil component which can reduce disconnection of a coil, and a method for manufacturing the same.

A coil component according to an aspect of the present disclosure includes a main body portion containing resin and having a hole portion; a coil provided in the main body portion; and a substantially cylindrical pipe arranged inside the hole portion. The coil includes an inner wiring embedded in the pipe and an outer wiring exposed from the main body portion, and the inner wiring and the outer wiring are integrally continuous.

Here, exposure of the outer wiring from the main body portion means that the outer wiring has a portion which is not covered with the main body portion, and the portion may be exposed to the outside of the coil component or may be exposed to another member. Another member may be embedded in the hole portion and also in this case, the corresponding portion is referred to as the hole portion.

With the coil component according to the aspect of the present disclosure, since the inner wiring and the outer wiring are integrally continuous, there is no bonding surface between the inner wiring and the outer wiring, and disconnection of the inner wiring and the outer wiring can be reduced.

Further, in one embodiment of the coil component, the outer wiring includes a top surface-side outer wiring exposed from a top surface of the main body portion and a bottom surface-side outer wiring exposed from a bottom surface of the main body portion, and the top surface-side outer wiring and the inner wiring are integrally continuous and the bottom surface-side outer wiring and the inner wiring are integrally continuous. According to this embodiment, since the inner wiring, the top surface-side outer wiring, and the bottom surface-side outer wiring are integrally continuous, there is no bonding surface between the inner wiring and the outer wiring and disconnection of the inner wiring and the outer wiring can be reduced.

Further, in one embodiment of the coil component, the inner wiring is formed into a substantially cylindrical shape, and resin is embedded in the inner wiring. According to this embodiment, since the resin is embedded in the inner wiring of the substantially cylindrical shape, thermal expansion of the inner wiring can be reduced.

In one embodiment of the coil component, the pipe contains resin. According to this embodiment, since the pipe contains the resin, characteristics of the pipe and the main body portion, such as coefficients of thermal expansion, can be made the same and close contact performance between the pipe and the main body portion is made preferable.

In one embodiment of the coil component, the resin is conductive resin. According to this embodiment, since the resin of the pipe is the conductive resin, it is possible to reduce resistance of the inner wiring.

In one embodiment of the coil component, the pipe contains ceramic. According to this embodiment, since the pipe contains the ceramic, characteristics of the pipe and the inner wiring, such as coefficients of thermal expansion, can be approximated and close contact performance between the pipe and the inner wiring is made preferable.

Further, in one embodiment of the coil component, a substantially annular core provided in the main body portion is provided and the coil is wound around the core. According to this embodiment, a coil can be formed without reducing manufacturing efficiency in a toroidal coil that tends to be complicated in a manufacturing process.

In addition, one embodiment of a method for manufacturing a coil component according to another aspect of the disclosure includes standing a substantially cylindrical pipe at a position corresponding to a coil on a substrate; forming a main body portion having a hole portion in which the pipe has been arranged by molding the pipe on the substrate with resin in a state of making an inner surface of the pipe be exposed; and forming a wiring of the coil by plating on the inner surface of the pipe and an outer surface of the resin. According to this embodiment, since the wiring of the coil is formed by plating on the inner surface of the pipe and the outer surface of the resin, the inner wiring embedded in the main body portion and the outer wiring exposed from the main body portion can be integrally formed to be continuous. Thus, no bonding surface is formed between the inner wiring and the outer wiring and disconnection of the inner wiring and the outer wiring can be reduced.

Other features, elements, characteristics and advantages of the present disclosure will become more apparent from the following detailed description, with reference to the attached drawings.

DETAILED DESCRIPTION

Hereinafter, one mode of the present disclosure will be described more in detail with reference to an illustrated embodiment.

Figure 1:
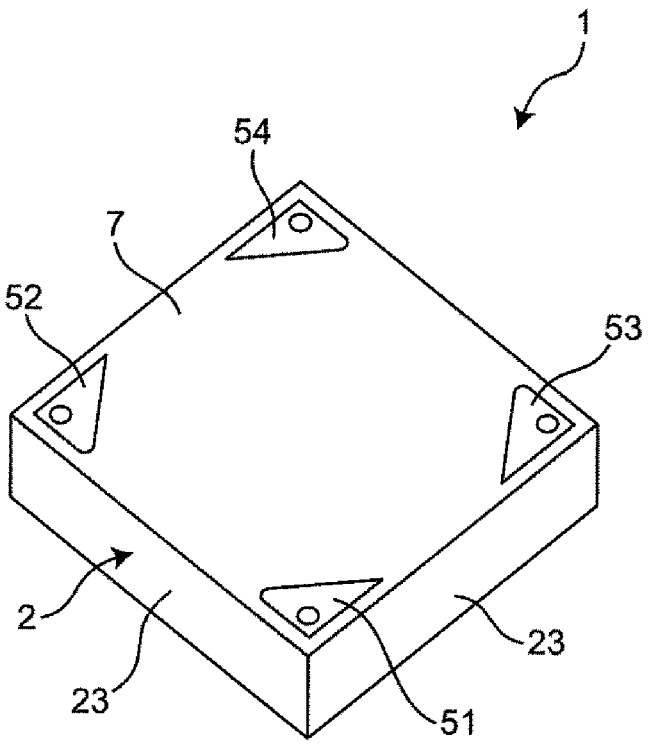
FIG. 1 is a perspective view illustrating a coil component as an embodiment of a coil component.
Figure 2:
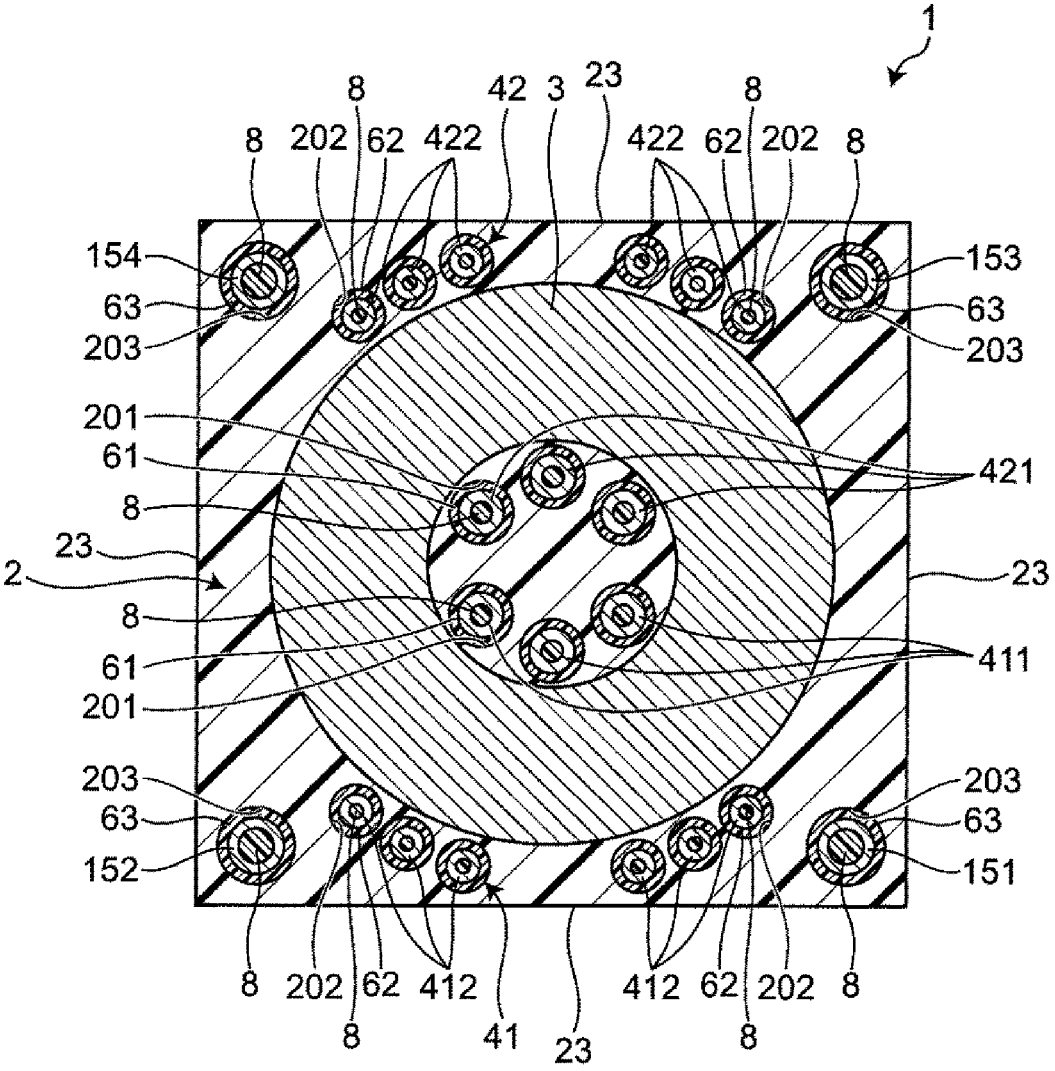
FIG. 2 is a cross-sectional view of the coil component.
Figure 3A:
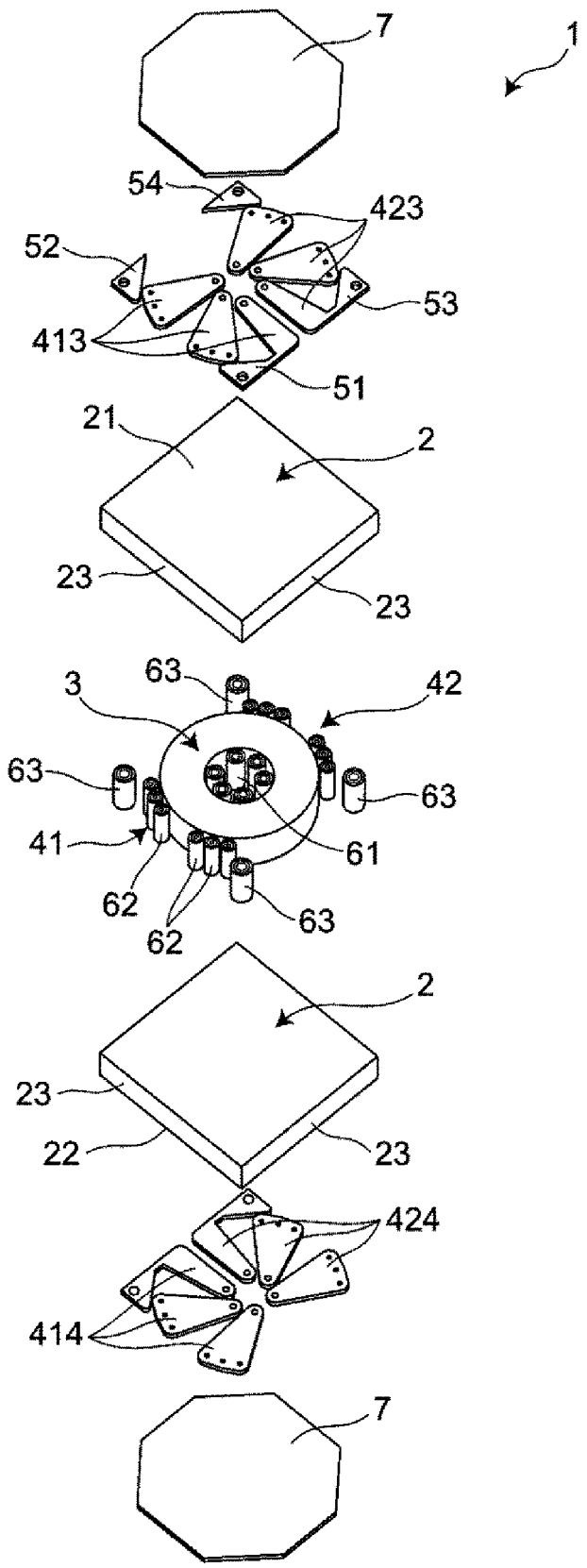
FIG. 3A is an exploded perspective view of the coil component.
Figure 3B:
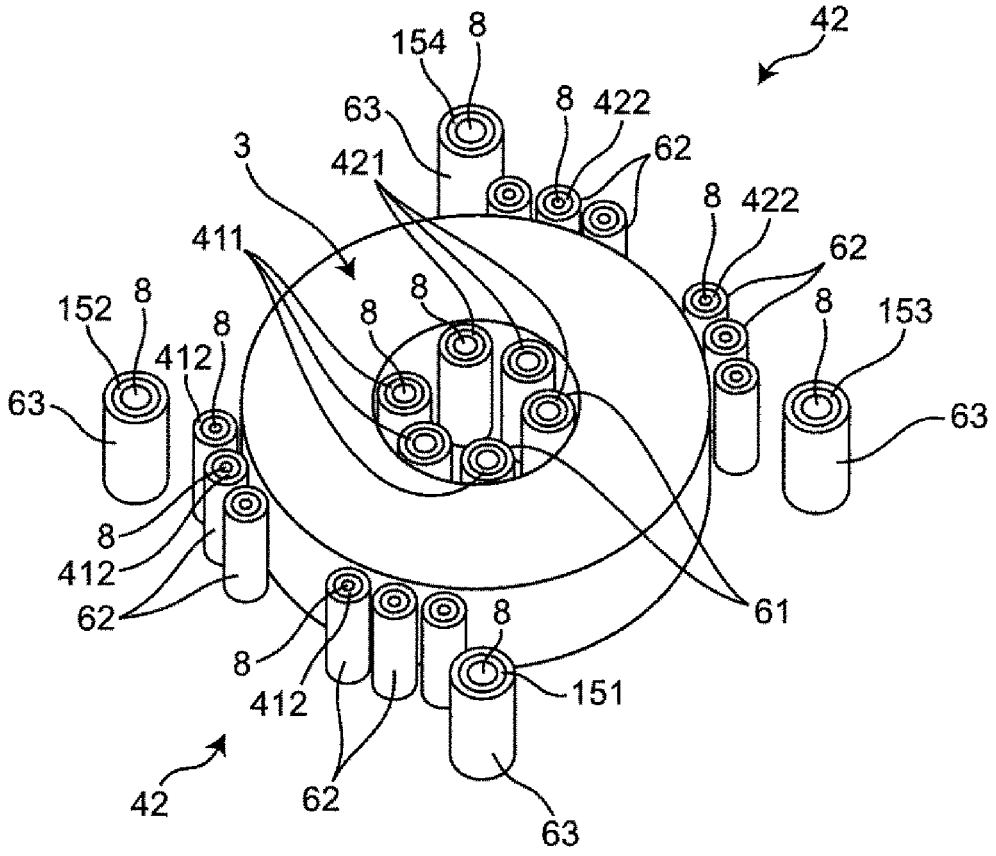
FIG. 3B is a partially enlarged view of FIG. 3A.

FIG. 1 is a perspective view illustrating a coil component as an embodiment of the disclosure. FIG. 2 is a cross-sectional view of the coil component. FIG. 3A is an exploded perspective view of the coil component. FIG. 3B is a partially enlarged view of FIG. 3A.

As illustrated in FIGS. 1, 2, 3A, and 3B, a coil component 1 includes a main body portion 2, a substantially annular core 3 provided in the main body portion 2, a first coil 41 and a second coil 42 that are provided in the main body portion 2 and are wound around the core 3, and first, second, third, and fourth outer electrodes 51, 52, 53, and 54 that are electrically connected to the first coil 41 and the second coil 42.

The main body portion 2 contains resin. A resin material is, for example, epoxy resin, but may be polyetheretherketone, polyimide, polyamide, polyetherimide, or the like. The main body portion 2 has a substantially rectangular parallelepiped shape, and the surface of the main body portion 2 is formed by a top surface 21, a bottom surface 22, and four side surfaces 23. The top surface 21 is a surface at a side along which the coil component 1 is mounted on a mounting substrate.

The core 3 is composed of, for example, a ceramic core such as ferrite or a metal-based core. The core 3 has an upper end surface and a lower end surface which face each other in the central axis direction. The upper end surface faces the top surface 21 of the main body portion 2. The lower end surface faces the bottom surface 22 of the main body portion 2. The shape of the core 3 may be a substantially elliptical shape, a substantially rectangular shape, or a substantially polygonal shape other than a substantially circular shape in plan view. Also, the cross-sectional shape of the core 3 is not limited to a substantially rectangular shape as illustrated in the drawings, and may be a substantially circular shape, a substantially elliptical shape, or a substantially polygonal shape.

The main body portion 2 has a plurality of first hole portions 201, second hole portions 202, and third hole portions 203 penetrating through the main body portion 2 from the top surface 21 to the bottom surface 22. The first hole portions 201 are arranged in inner side portions of the core 3 in the radial direction, the second hole portions 202 are arranged in outer side portions of the core 3 in the radial direction, and the third hole portions 203 are arranged at four corners of the main body portion 2.

The first to fourth outer electrodes 51 to 54 are made of, for example, metal such as copper, gold, or silver. The first outer electrodes 51 and the third outer electrode 53 are provided on the top surface 21 of the main body portion 2. The second outer electrode 52 and the fourth outer electrode 54 are provided on the top surface 21 of the main body portion 2.

The first coil 41 and the second coil 42 are made of, for example, metal such as copper, gold, or silver. The first coil 41 and the second coil 42 are arranged so as to face each other. The winding direction of the first coil 41 around the core 3 is opposite to the winding direction of the second coil 42 around the core 3. The number of turns of the first coil 41 and the number of turns of the second coil 42 are the same.

One end of the first coil 41 is connected to the first outer electrode 51, and the other end of the first coil 41 is connected to the second outer electrode 52. One end of the second coil 42 is connected to the third outer electrode 53, and the other end of the second coil 42 is connected to the fourth outer electrode 54. The coil component 1 constitutes a common mode choke coil having the first and third outer electrodes 51 and 53 as input terminals (output terminals) and the second and fourth outer electrodes 52 and 54 as output terminals (input terminals).

The first coil 41 includes first wirings 411 embedded in the first hole portions 201 of the main body portion 2, second wirings 412 embedded in the second hole portions 202 of the main body portion 2, third wirings 413 exposed from the top surface 21 of the main body portion 2, and fourth wirings 414 exposed from the bottom surface 22 of the main body portion 2.

Here, the exposure of the third and fourth wirings 413 and 414 from the main body portion 2 means that the third and fourth wirings 413 and 414 have portions which are not covered with the main body portion 2, and the portions may be exposed to the outside of the coil component 1 or may be exposed to another member. The first wirings 411 and the second wirings 412 are examples of an "inner wiring" in the scope of the disclosure. The third wirings 413 and the fourth wirings 414 are examples of an "outer wiring" in the scope of the disclosure.

The first wirings 411 and the third wirings 413, the first wirings 411 and the fourth wirings 414, the second wirings 412 and the third wirings 413, and the second wirings 412 and the fourth wirings 414 are integrally continuous. The first to fourth wirings 411 to 414 are formed by plating, for example. Accordingly, there is no bonding surface between the first and second wirings 411 and 412 (inner wiring) and the third and fourth wirings 413 and 414 (outer wiring), and disconnection of the first and second wirings 411 and 412 and the third and fourth wirings 413 and 414 can be reduced.

First pipes 61 are present between the first wirings 411 and the inner surfaces of the first hole portions 201 of the main body portion 2. In other words, the first pipes 61 are inserted into the first hole portions 201 of the main body portion 2, and the first wirings 411 are provided on the inner surfaces of the first pipes 61. In this case, roughnesses of the inner surfaces of the first pipes 61 are preferably smaller than roughnesses of the inner surfaces of the first hole portions 201 of the main body portion 2. With this, the roughnesses of the inner surfaces of the first hole portions 201 can be absorbed by the first pipes 61 and the thicknesses of the first wirings 411 can be uniformly reduced.

Second pipes 62 are present between the second wirings 412 and the inner surfaces of the second hole portions 202 of the main body portion 2. In other words, the second pipes 62 are inserted into the second hole portions 202 of the main body portion 2, and the second wirings 412 are provided on the inner surfaces of the second pipes 62. In this case, roughnesses of the inner surfaces of the second pipes 62 are preferably smaller than roughnesses of the inner surfaces of the second hole portions 202 of the main body portion 2. With this, the roughnesses of the inner surfaces of the second hole portions 202 can be absorbed by the second pipes 62 and the thicknesses of the second wirings 412 can be uniformly reduced.

The first and second pipes 61 and 62 contain, for example, resin or ceramic. When the first and second pipes 61 and 62 contain resin, characteristics of the first and second pipes 61 and 62 and the main body portion 2, such as coefficients of thermal expansions, can be the same, and close contact performance between the first and second pipes 61 and 62 and the main body portion 2 is made preferable. When the first and second pipes 61 and 62 contain ceramics, characteristics of the first and second pipes 61 and 62 and the first and second wirings 411 and 412, such as coefficients of thermal expansions, can be approximated, and close contact performance between the first and second pipes 61 and 62 and the first and second wirings 411 and 412 is made preferable.

Examples of a resin material for the first and second pipes 61 and 62 include polyetheretherketone, polyimide, polyamide, and polyetherimide. Examples of a ceramic material for the first and second pipes 61 and 62 include alumina, mullite, zirconia, and sialon. The first and second pipes 61 and 62 have shapes substantially along the inner surfaces of the first and second hole portions 201 and 202, whereby the thicknesses of the first and second pipes 61 and 62 can be uniformly reduced and the amount of resin material can be reduced.

The first and second wirings 411 and 412 are substantially cylindrical, and resin 8 is embedded in the first and second wirings 411 and 412. Therefore, the resin 8 can reduce thermal expansion of the first and second wirings 411 and 412. Note that the inside of the first and second wirings 411 and 412 may be made hollow without providing the resin 8. The resin 8 may be conductive resin containing a conductive material such as metal powder, and in this case, the first and second wirings 411 and 412 can be reduced in resistance.

Similarly to the first coil 41, the second coil 42 includes first wirings 421, second wirings 422, third wirings 423, and fourth wirings 424. The first and second wirings 421 and 422 (inner wirings) and the third and fourth wirings 423 and 424 (outer wirings) are integrally continuous. The first pipes 61 are present between the first wirings 421 and the inner surfaces of the first hole portions 201 of the main body portion 2 and the second pipes 62 are present between the second wirings 422 and the inner surfaces of the second hole portions 202 of the main body portion 2.

Third pipes 63 are inserted into the third hole portions 203 at the four corners of the main body portion 2. The third pipes 63 are made of the same material as the first and second pipes 61 and 62. On the respective inner surfaces of the third pipes 63 at the four corners, first to fourth connection wirings 151 to 154 are provided.

The first connection wiring 151 is connected to the first outer electrode 51 on the top surface 21. The second connection wiring 152 is connected to the second outer electrode 52 on the top surface 21. The third connection wiring 153 is connected to the third outer electrode 53 on the top surface 21. The fourth connection wiring 154 is connected to the fourth outer electrode 54 on the top surface 21.

The first connection wiring 151 and the first outer electrode 51, the second connection wiring 152 and the second outer electrode 52, the third connection wiring 153 and the third outer electrode 53, and the fourth connection wiring 154 and the fourth outer electrode 54 are integrally continuous.

Figure 4:
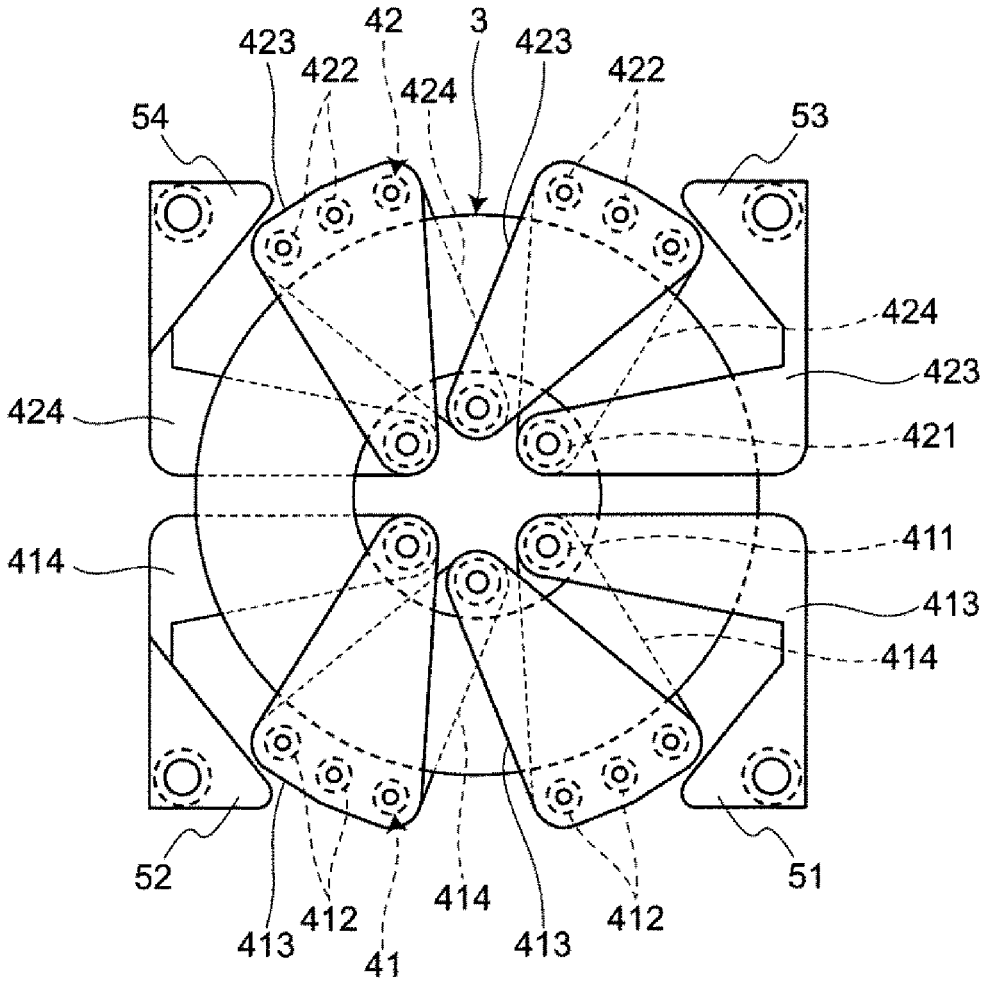
FIG. 4 is a descriptive view for explaining a connection state of a coil.

FIG. 4 is a descriptive view for explaining a connection state of the coils 41 and 42. As illustrated in FIGS. 3A, 3B, and 4, the plurality of wirings 411, 412, 413, and 414 is connected to form the first coil 41.

The first wirings 411 and the second wirings 412 are formed in the substantially cylindrical shapes. The first wirings 411 are arranged in inner side portions of the core 3 in the radial direction along the central axis of the core 3. The second wirings 412 are arranged in outer side portions of the core 3 in the radial direction along the central axis of the core 3. The first wirings 411 and the second wirings 412 are embedded in the main body portion 2.

The third wirings 413 and the fourth wirings 414 are formed in substantially film shapes. The third wirings 413 are arranged on the upper end surface of the core 3 along a plane orthogonal to the central axis of the core 3. The fourth wirings 414 are arranged on the lower end surface of the core 3 along a plane orthogonal to the central axis of the core 3.

One end of the third wiring 413 is connected to one end of the first wiring 411, the other end of the first wiring 411 is connected to one end of the fourth wiring 414, the other end of the fourth wiring 414 is connected to one ends of the three second wirings 412, and the other ends of the three second wirings 412 are connected to one end of another third wiring 413. By repeating this, the third wirings 413, the first wirings 411, the fourth wirings 414, and the second wirings 412 are spirally wound around the core 3. In other words, a unit element of one turn is constituted by one set of the third wirings 413, the first wiring 411, the fourth wiring 414, and the second wirings 412.

The first outer electrode 51 is connected to the third wiring 413. The first outer electrode 51 is integrally continuous with the third wiring 413. The first outer electrode 51 and the third wiring 413 are formed by, for example, plating. Thus, there is no bonding surface between the first outer electrode 51 and the third wiring 413, and disconnection of the first outer electrode 51 and the third wiring 413 can be reduced.

Similarly to the first coil 41, the plurality of wirings 421, 422, 423, and 424 is connected to form the second coil 42. In other words, the first wirings 421 are arranged in inner side portions of the core 3 in the radial direction, and the second wirings 422 are arranged in outer side portions of the core 3 in the radial direction. The third wirings 423 are arranged on the upper end surface of the core 3, and the fourth wirings 424 are arranged on the lower end surface of the core 3.

The third wirings 423, the first wirings 421, the fourth wirings 424, and the second wirings 422 are sequentially connected and spirally wound around the core 3. The third outer electrode 53 is integrally continuous with the third wiring 423, there is no bonding surface between the third outer electrode 53 and the third wiring 423, and disconnection of the third outer electrode 53 and the third wiring 423 can be reduced.

The third wirings 413 of the first coil 41 and the third wirings 423 of the second coil 42 are covered with a protective sheet 7 at the upper side. The fourth wirings 414 of the first coil 41 and the fourth wirings 424 of the second coil 42 are covered with the protective sheet 7 at the lower side. The protective sheet 7 has an insulating property and may be insulating resin or a substrate such as glass epoxy. Therefore, it is possible to easily improve the insulating property of the wirings exposed from the main body portion 2.

Next, a method for manufacturing the coil component 1 will be described.

Figure 5A:
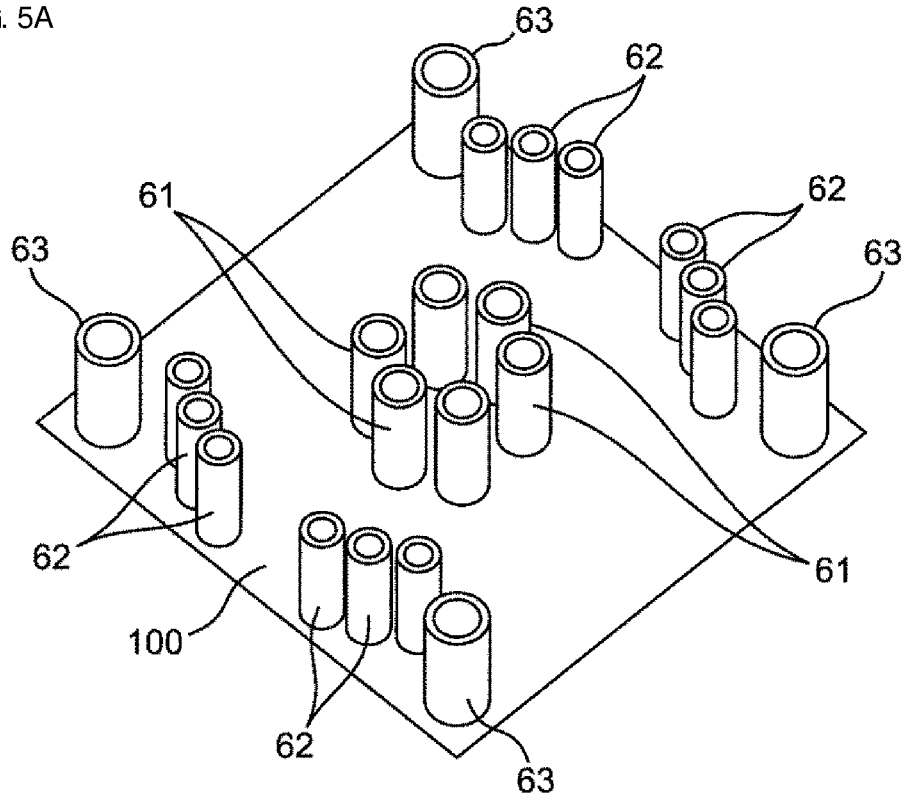
FIG. 5A is a descriptive view for explaining a method for manufacturing the coil component.

As illustrated in FIG. 5A, the pipes 61 and 62 are made to stand at positions corresponding to the coils 41 and 42 on a substrate 100 containing resin. That is, the first pipes 61 are made to stand at the positions corresponding to the first wirings 411 of the first coil 41 and the first wirings 421 of the second coil 42, and the second pipes 62 are made to stand at the positions corresponding to the second wirings 412 of the first coil 41 and the second wirings 422 of the second coil 42. Further, the third pipes 63 are made to stand at four corners of the substrate 100 at positions corresponding to the first to fourth connection wirings 151 to 154.

Figure 5B:
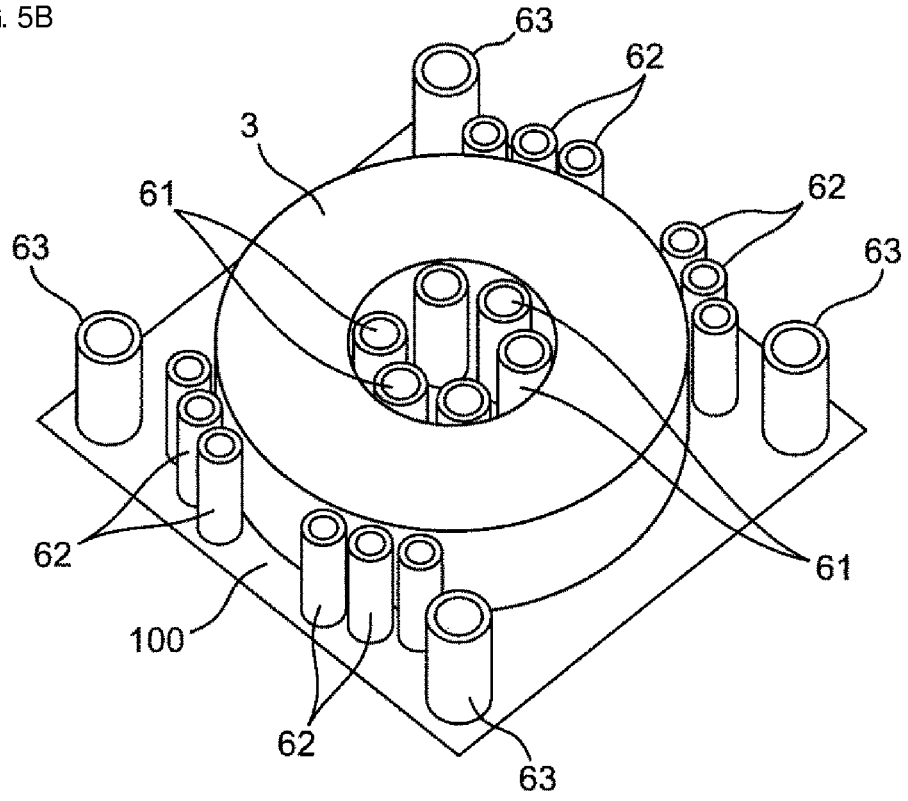
FIG. 5B is a descriptive view for explaining the method for manufacturing the coil component.

As illustrated in FIG. 5B, the core 3 is installed on the substrate 100. At this time, the first pipes 61 are arranged in the inner side portions of the core 3 in the radial direction, and the second pipes 62 are arranged in the outer side portions of the core 3 in the radial direction.

Figure 5C:
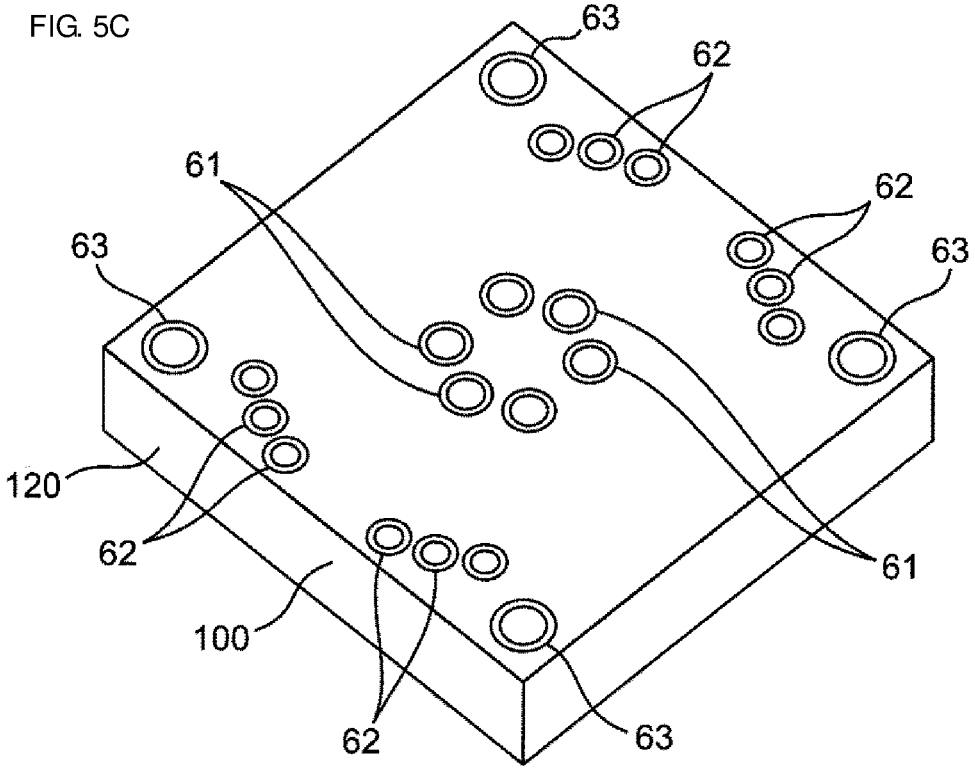
FIG. 5C is a descriptive view for explaining the method for manufacturing the coil component.

As illustrated in FIG. 5C, the pipes 61, 62, and 63 and the core 3 on the substrate 100 are molded with resin 120. At this time, the inner surfaces of the pipes 61, 62, and 63 are exposed. Thereafter, the front and rear surfaces are ground to provide a predetermined thickness. At this time, all portions of the substrate 100 are ground to make the end surfaces of the pipes 61, 62, and 63 be exposed from the resin 120.

Figure 5D:
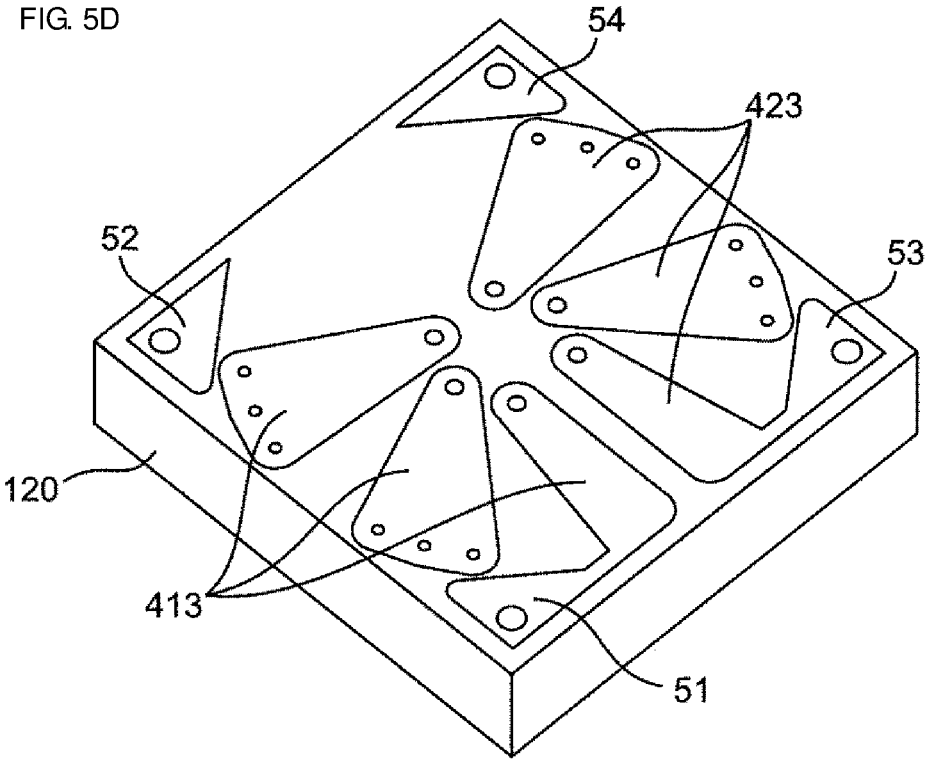
FIG. 5D is a descriptive view for explaining the method for manufacturing the coil component.

As illustrated in FIG. 5D, wirings of the coils are formed by plating on the inner surfaces of the pipes 61, 62, and 63 and the outer surface of the resin 120. More specifically, the first wirings 411 and 421 are provided in the first pipes 61, the second wirings 412 and 422 are provided in the second pipes 62, and the first to fourth connection wirings 151 to 154 are provided in the third pipes 63. The third wirings 413 and 423 and the fourth wirings 414 and 424 are provided on the outer surfaces of the resin 120. Accordingly, the inner wirings (the first wirings 411 and 421 and the second wirings 412 and 422) and the outer wirings (the third wirings 413 and 423 and the fourth wirings 414 and 424) can be integrally and continuously formed. Thus, no bonding surface is formed between the inner wirings and the outer wirings and disconnection of the inner wirings and the outer wirings can be reduced.

Further, at the same time as the wiring of the coils, the first to fourth outer electrodes 51 to 54 are formed by plating. Thus, the first and third outer electrodes 51 and 53 and the outer wirings (third wirings 413 and 423) can be integrally and continuously formed. As described above, since the inner wirings, the outer wirings, and the outer electrodes are formed by plating, the inner wirings, the outer wirings, and the outer electrodes can be formed at a time and manufacturing time can be shortened.

Thereafter, the protective sheets 7 are provided on the upper and lower surfaces of the resin 120 so as to cover the third wirings 413 and 423 and the fourth wirings 414 and 424, thereby manufacturing the coil component 1 illustrated in FIG. 1. The main body portion 2 is made of the resin 120. In FIG. 5C, a part of the substrate 100 may be left without being ground, and in this case, the main body portion 2 is formed of the substrate 100 and the resin 120.

Note that the present disclosure is not limited to the above-described embodiment, and design changes can be made without departing from the gist of the present disclosure.

In the above embodiment, the number of coils is two, but may be one or equal to or more than three. Further, the number of outer electrodes may be increased or decreased depending on the number of coils.

In the above embodiment, the coils include the outer wirings (third and fourth wirings) exposed from the top surface of the main body portion, and the inner wirings (first and second wirings) and the outer wiring are integrally continuous. Alternatively, the coils may include outer wirings exposed from the bottom surface or both of the top surface and the bottom surface of the main body portion, and the inner wirings and the outer wirings may be integrally continuous.

Although the core is provided in the above embodiment, the core may be omitted. In this case, for example, magnetic powder may be mixed in the main body portion.

In the above embodiment, the outer electrodes are provided on the top surface of the main body portion. Alternatively, a recess extending from the top surface of the main body portion toward the bottom surface thereof may be provided in the side surface of the main body portion, the outer electrode may be disposed in the recess, and a wall layer may be interposed between the outer electrode and the inner surface of the recess. In this case, the outer electrode and the wall layer may have a substantially arc shape obtained by cutting a substantially cylindrical pipe with a center angle of 90° when viewed from an axial direction thereof, may have a shape obtained by cutting it with any other center angle, or may have a shape obtained by cutting a substantially polygonal shape with an arbitrary center angle instead of the substantially arc shape.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a main body portion containing resin and having a plurality of hole portions;

a coil provided in the main body portion; and a substantially cylindrical pipe arranged inside each of the hole portions, wherein the coil includes an inner wiring embedded in the pipe and an outer wiring exposed from the main body portion, and the inner wiring and the outer wiring are integrally continuous, and wherein the inner wiring is formed into a substantially cylindrical shape and resin is embedded in the inner wiring.

2. The coil component according to claim 1, wherein the outer wiring includes a top surface-side outer wiring exposed from a top surface of the main body portion and a bottom surface-side outer wiring exposed from a bottom surface of the main body portion, and the top surface-side outer wiring and the inner wiring are integrally continuous, and the bottom surface-side outer wiring and the inner wiring are integrally continuous.

3. The coil component according to claim 2, wherein the pipe contains ceramic.

4. The coil component according to claim 2, further comprising:

a substantially annular core provided in the main body portion, and wherein the coil is wound around the core.

5. The coil component according to claim 1, wherein the resin is conductive resin.

6. The coil component according to claim 5, further comprising:

a substantially annular core provided in the main body portion, and wherein the coil is wound around the core.

7. The coil component according to claim 1, wherein the pipe contains ceramic.

8. The coil component according to claim 7, further comprising:

a substantially annular core provided in the main body portion, and wherein the coil is wound around the core.

9. The coil component according to claim 1, further comprising:

a substantially annular core provided in the main body portion, and wherein the coil is wound around the core.

10. A method for manufacturing the coil component of claim 1, the method comprising:

standing the substantially cylindrical pipe at a position corresponding to the coil on a substrate;

forming the main body portion having the hole portions in which the pipe has been arranged by molding the pipe on the substrate with resin in a state of making an inner surface of the pipe be exposed; and forming the inner wiring and the outer wiring of the coil by plating on the inner surface of the pipe and an outer surface of the resin.

* * * * *